US005203097A

United States Patent [19]

Blair

[11] Patent Number: 5,203,097

[45] Date of Patent: Apr. 20, 1993

[54] ATHLETIC SHOE OUTER SOLE FOR IMPROVED TRACTION

[76] Inventor: Roy D. Blair, 124 Cypress St., Watertown, Mass. 02172

[21] Appl. No.: 570,202

[22] Filed: Aug. 21, 1990

[51] Int. Cl.[5] ..... A43D 23/28

[52] U.S. Cl. ..... 36/59 C; 36/25 R; 36/114; D2/320

[58] Field of Search ..... D2/320, 321; 36/114, 36/25 R, 35 R, 59 C, 59 R, 32 R

[56] References Cited

U.S. PATENT DOCUMENTS

| | | | |
|---|---|---|---|
| D. 39,747 | 1/1909 | McKenna | D2/320 |
| D. 201,952 | 8/1965 | Johns | D2/320 |
| D. 234,930 | 4/1975 | Arambasic | D2/320 |
| D. 238,123 | 12/1975 | Davis | D2/320 |
| D. 242,091 | 11/1976 | Tornero | D2/320 |
| D. 259,595 | 6/1981 | Famolare, Jr. | D2/320 |
| D. 266,287 | 9/1982 | Blissett et al. | D2/320 |
| D. 267,288 | 12/1982 | Davis | D2/320 |
| D. 310,132 | 8/1990 | Hase | D2/320 |
| 4,045,888 | 9/1977 | Oxenberg | 36/32 R X |
| 4,096,649 | 6/1978 | Saurwein | 36/32 R |
| 4,562,651 | 1/1986 | Frederick et al. | 36/32 R X |
| 4,653,206 | 3/1987 | Tanel | 36/59 C X |

*Primary Examiner*—Paul T. Sewell
*Assistant Examiner*—BethAnne Cicconi
*Attorney, Agent, or Firm*—Robert T. Dunn

[57] ABSTRACT

An athletic shoe for use on a relatively hard playing surface has an outer ground sole with grooves therein that define ribs between adjacent grooves, particularly in the toe and ball areas of the sole, is characterized in that the grooves are generally arranged in concentric curves with reference to the center of the toe and ball area and the grooves define similarly arranged concentric ribs between adjacent grooves, each groove being defined by two evenly spaced walls into the surface of the sole, the outer wall and the inner wall, the outer wall being substantially perpendicular to the sole surface and the inner wall being tapered from the sole surface toward the outer wall to the bottom of the groove. Thus, each rib has an inner side substantially perpendicular to the sole surface and an outer side that tapers from the sole surface toward the outer perimeter of the sole. This groove and rib design minimizes the tendency of hard particles becoming stuck in the groove and soft material becoming packed in the groove; and so it minimizes groove clogging. Furthermore, the arrangement of ribs in the areas of the outer sole that bear the hardest against the playing surface in dynamic action have the perpendicular side thereof oriented transverse to the direction of slipping associated with the action and the effect of the perpendicular side is to clean the playing surface so that the surface of the rib contacting the playing surface will stick to the playing surface.

14 Claims, 4 Drawing Sheets

ATHLETIC SHOE OUTER SOLE FOR IMPROVED TRACTION

BACKGROUND OF THE INVENTION

This invention relates to athletic shoes with grooves in the outer sole surface to increase traction and more particularly to such athletic shoes providing improved traction during dynamic use on a variety of relatively hard playing surfaces due to the shape, orientation and distribution of the grooves.

Athletes and players perform on a great variety of playing surfaces including natural grass and dirt, synthetic or artificial turf and artificial composition surfaces used for field games like football, soccer, lacrosse and baseball and court games like basketball, tennis, racketball and squash. Natural grass and artificial turf are clearly not the same. Artificial turf has different properties than natural grass. On natural grass fields, the well-known replaceable conical cleat used on football, soccer and lacrosse shoes penetrates the grass surface into the soil and the lateral forces exerted on the hole in the soil caused by the penetrating cleat are contained; and, as a result, the player propels himself in the direction he intends without slipping. However, such replaceable conical cleats suitable on natural grass are not suitable on artificial turf, because the artificial turf cannot be penetrated.

For play on artificial turf that has tufts of fibers on the surface as a simulation of grass, many small cleats are molded as an integral part of the shoe outer sole. These include soles with many small cleats. The arrangements of the small cleats on the sole vary, and some offer soles with cleats of different sizes. Since the cleats do not penetrate the surface of the artificial turf, traction depends upon the friction between the end of the cleat and the tufts of fibers on the surface. The acceptance of any specific cleat design depends largely on the preference of the players. One such molded cleat outer sole is described in my U.S. Pat. No. 4,586,274, entitled "Athletic Shoe Cleats For Artificial Turf", which issued May 6, 1986.

Thus, cleats are the clear favorite in field sports for use on natural grass and/or dirt. Although cleats are widely used on artificial turf, non-cleated shoes are also used on that surface as described in my above mentioned U.S. patent. For some games, like tennis, cleats cannot be used even on natural grass or dirt, because cleats would so disturb (damage) the playing surface that the ball would not bounce evenly and would require much repair after each use. Clearly, cleated shoes cannot be used on smooth hard surfaces, because they would slip too easily and they cannot be used on smooth resilient surfaces, because they are not effective and would damage the surface. Cleated shoes are usually removed when the user leaves the playing field, because they slip on other surfaces and/or may damage other surfaces and they are simply not comfortable on other surfaces.

It is an object of the present invention to provide an improved outer sole for an athletic shoe that does not have cleats projecting from the outer sole surface.

It is another object to provide a groove design and an arrangement of grooves on the outer sole surface of an athletic shoe that affords the wearer improved dynamic traction.

It is another object to provide an improved outer sole for an athletic shoe that enables the wearer to have the necessary traction on a playing surface when the wearer intentionally accelerates in any direction in normal athletic activity.

It is another object to provide an athletic shoe outer sole having particularly advantageous use on hard playing surfaces.

It is an object of the present invention to provide an improved outer sole for an athletic shoe that does not have cleats projecting from the outer sole surface.

It is another object to provide a groove design and an arrangement of grooves on the outer sole surface of an athletic shoe that affords the wearer improved dynamic traction and does not pick up foreign objects or material.

It is another object to provide an improved outer sole for an athletic shoe that enables the wearer to have the necessary traction on a playing surface when the wearer intentionally accelerates in any direction in normal athletic activity and does not pick up foreign objects or material.

It is another object to provide an outer sole for a basketball shoe that affords the wearer improved resistance to slipping in dynamic action.

It is another object to provide an outer sole for a hard court tennis shoe that affords the wearer improved resistance to slipping in dynamic action.

It is another object to provide an outer sole for a grass court tennis shoe that affords the wearer improved resistance to slipping in dynamic action.

It is another object to provide an outer sole for a hard court racketball or handball shoe that affords the wearer improved resistance to slipping in dynamic action.

It is another object to provide an outer sole for a deck shoe that affords the wearer improved resistance to slipping.

SUMMARY OF THE INVENTION

In a preferred embodiment of the present invention, the outer sole of an athletic shoe is made in a unitary, molded piece consisting of a toe area, a ball area, an arch area and a heel area and an arrangement of grooves that define ribs is provided in at least the toe and ball areas. The grooves, particularly in the toe and ball area are characterized in that they are generally arranged side by side in evenly spaced curves that follow the periphery of the sole and the grooves define similarly arranged ribs between adjacent grooves. Each groove is defined by two evenly spaced walls into the surface of the sole, the outer wall and the inner wall, the outer wall being substantially perpendicular to the sole surface and the inner wall being tapered from the sole surface toward the outer wall to the bottom of the groove. By this arrangement, the ribs between adjacent grooves in the area of the outer sole surface that bears hardest against the playing surface during dynamic action are oriented transverse to the direction of the slipping force associated with the action; and, in particular, the relative direction of slipping of the sole surface with respect to the playing surface is toward the tapered wall and resistance to slipping is toward the perpendicular wall of those grooves that define such a rib.

In a preferred embodiment of the present invention, the grooves and ribs each form a closed loop and the closed loops of ribs are located one inside another from the smallest loop at the center of the toe and ball area to the largest loop at the periphery thereof.

Other objects, features and advantages of the present invention will be apparent in view of the following description of embodiments of the invention which represent the best known uses of the invention. The invention accordingly comprises the elements and combinations of elements, features of construction and arrangements of parts which are exemplified in the structures herein described and in the scope of the appended claims.

The several embodiments of the invention are described in the accompanying drawings.

DESCRIPTIONS OF EMBODIMENTS OF THE INVENTION the shoe outer sole. These

Figure 1:
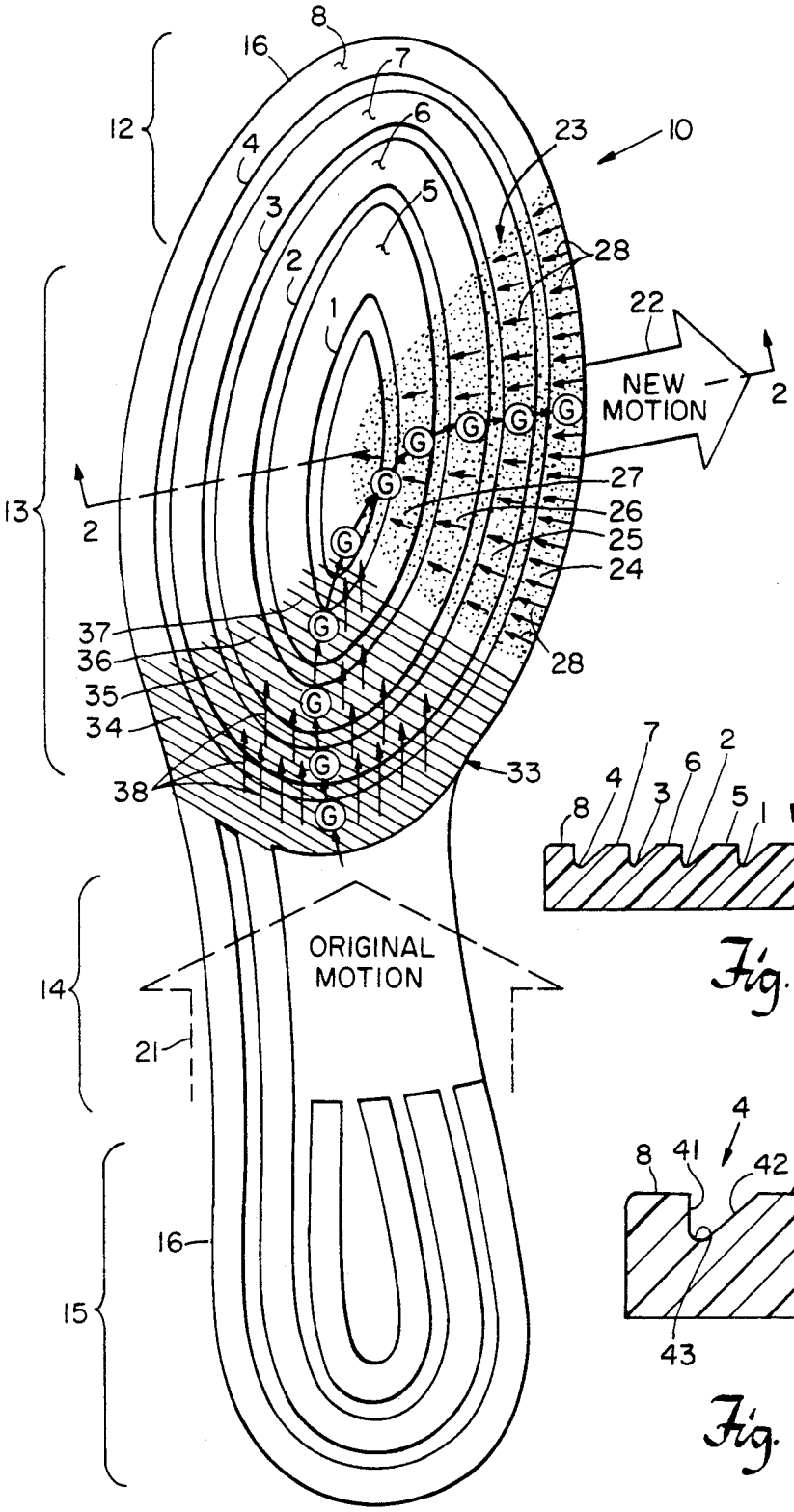
FIGS. 1 and 2 are plan and cross-section views, respectively, of the toe and ball area of the outer sole showing the arrangement of grooves and ribs thereon in accordance with the present invention and the locations and directions of dynamic forces on the sole during conventional activity.
Figure 2:
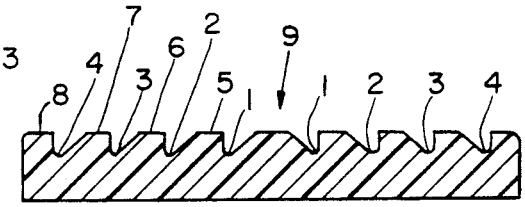

Turning first to FIGS. 1 and 2, FIG. 1 is a view of the bottom of the right shoe seen looking up through the playing surface that the shoe is in contact with, as though the playing surface were transparent. These Figures represent the generic application of the present invention.

The distribution and orientation of the closed loop grooves 1 to 4 and closed loop ribs 5 to 8 in the surface 9 of outer sole 10 for dynamic performance must take into account weight shifts to the portion of the foot bone structure and the shoe outer sole in the direction of the players motion. For example, in the case of the propelling foot, the forces on the sole surface are in the direction of the acceleration of motion and as the propelling foot begins losing friction with the playing surface (as it lifts from the playing surface), a portion of the sole perimeter of the propelling foot still in contact with that surface must provide a higher amount of friction with the surface and still support the weight of the player plus the vertical force he may be exerting on the surface to propel his body upward, and so it is necessary that a small portion of the sole (the portion still in contact with the playing surface) be capable of providing sufficient friction to oppose the force delivered by the player as he accelerates.

As shown in FIG. 1, the periphery 16 of sole 10 encloses the toe area 12, the ball area 13, the arch area 14 and the heel area 15. The toe area and ball area must provide resistance against slipping backwards, the back of the heel area and the back of the ball area must provide resistance against slipping foreward, the left side of the sole must provides resistance against slipping to the right, the right side must provides resistance against slipping to the left and slipping in all directions in between those should be resisted by at least some sections of the ribs that are in forcible contact with the playing surface at the time. The arch area 14 of the sole contributes little to traction as it bears little weight and serves as a bridge between the heel and ball areas and is recessed.

For example, as shown in FIG. 1, the original motion of the wearer is forward in the direction of arrow 21 when the right foot contacts the playing surface. When the wearer decreases forward motion by decelerating, he applies the rear part of the ball area, shown as cross hatched area 33, to the playing surface to cause a new motion (decrease the forward motion) by forces distributed along rib sections 34, 35, 36 and 37. Those forces are represented by many small vectors 38 which are all transverse to the corresponding rib sections. Similarly, when the wearer pushes off with his right foot in a new direction to his left, his body then moves (accelerates) in the new direction indicated by arrow 22. This is done by the wearer applying the left side of the ball and toe area, shown as darkened area 23, against the playing surface so that area 23 applies a force on the playing surface to the wearer's right along sections 24, 25, 26 and 27 of the ribs in area 23. Those forces are distributed along those rib sections as represented by the many small vectors 28 which are all substantially transverse to the corresponding rib sections.

According to embodiments of the present invention, all of the above features are realized with a design and arrangement of grooves 1 to 4 and ribs 5 to 8 in the sole surface shown in FIGS. 1 and 2. It produces highly effective friction resistance with the playing surface, principally in one direction, and that direction for each section of each rib is determined by the cross-section geometry, location and orientation of each section of each rib. For a shoe equipped with such ribs, friction resistance in different directions is provided by the distribution and the orientation of the ribs in the outer sole surface in consideration of the way the wearer's foot contacts the playing surface during the usual running maneuvers of the game. Thus, the cross-section geometry of the grooves and ribs, the position of each section of a rib on the sole and the orientation of the ribs, in consideration of the wearer's dynamic maneuvers are all factors in bringing about and accomplishing the above described features and performances.

Figure 3:
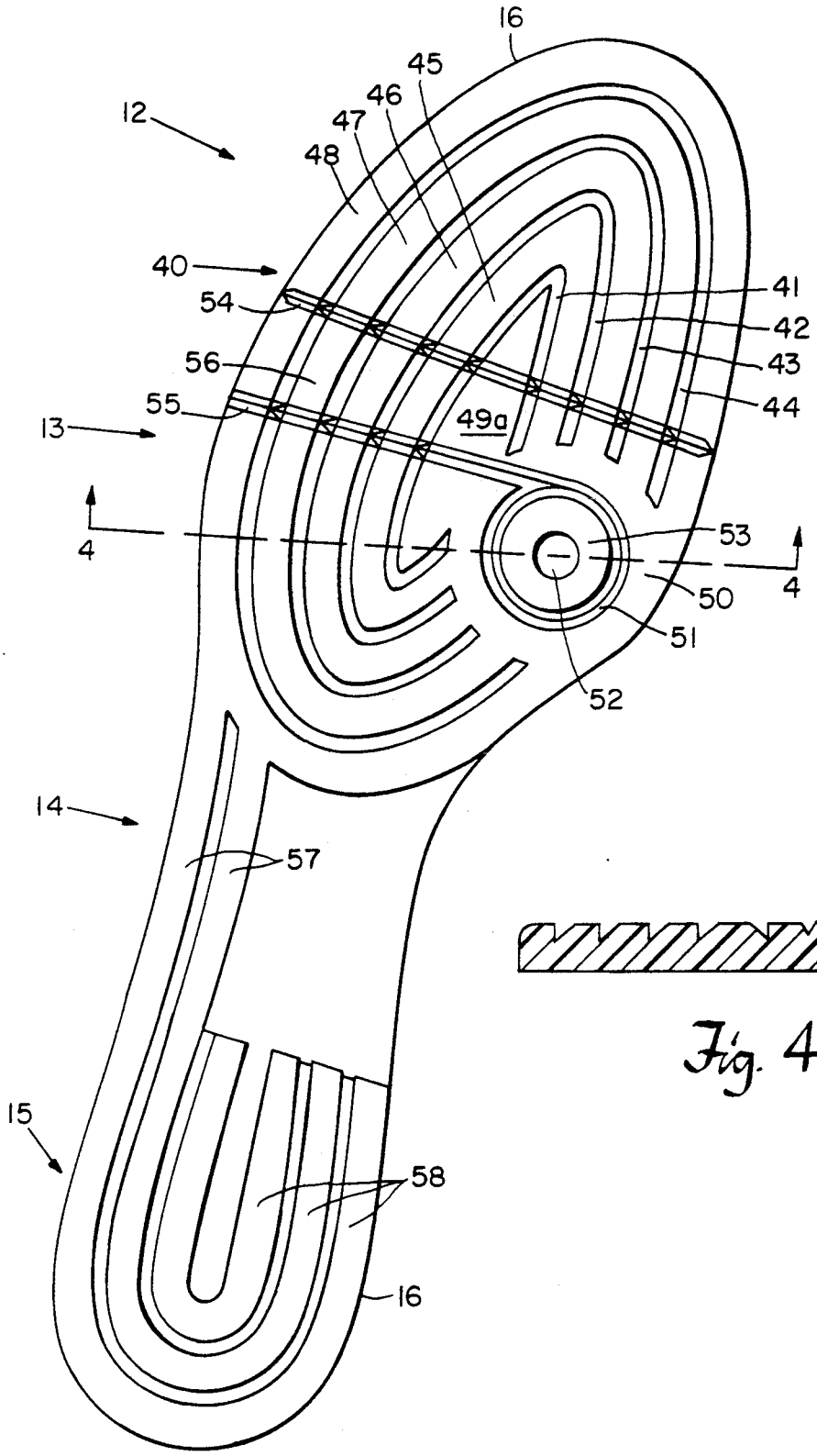
FIGS. 3 and 4 are plan and cross-section views, respectively, of the total outer sole surface of a basketball shoe showing the arrangement of grooves and ribs thereon in accordance with the present invention.
Figure 5:
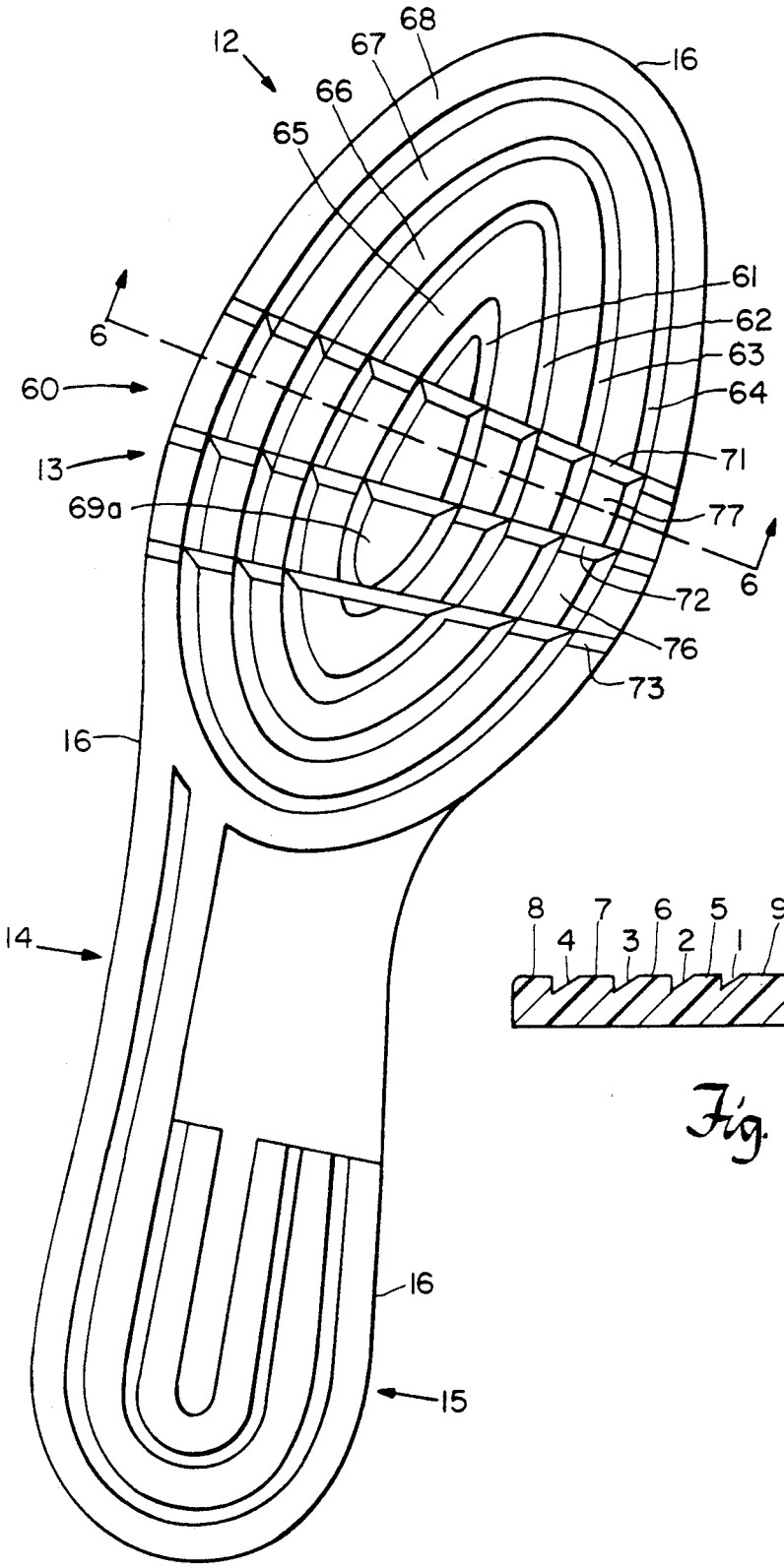
FIGS. 5 and 6 are plan and cross-section views, respectively, of the total outer sole surface of a hard court tennis, squash or handball shoe showing the arrangement of grooves and ribs thereon in accordance with the present invention.
Figure 7:
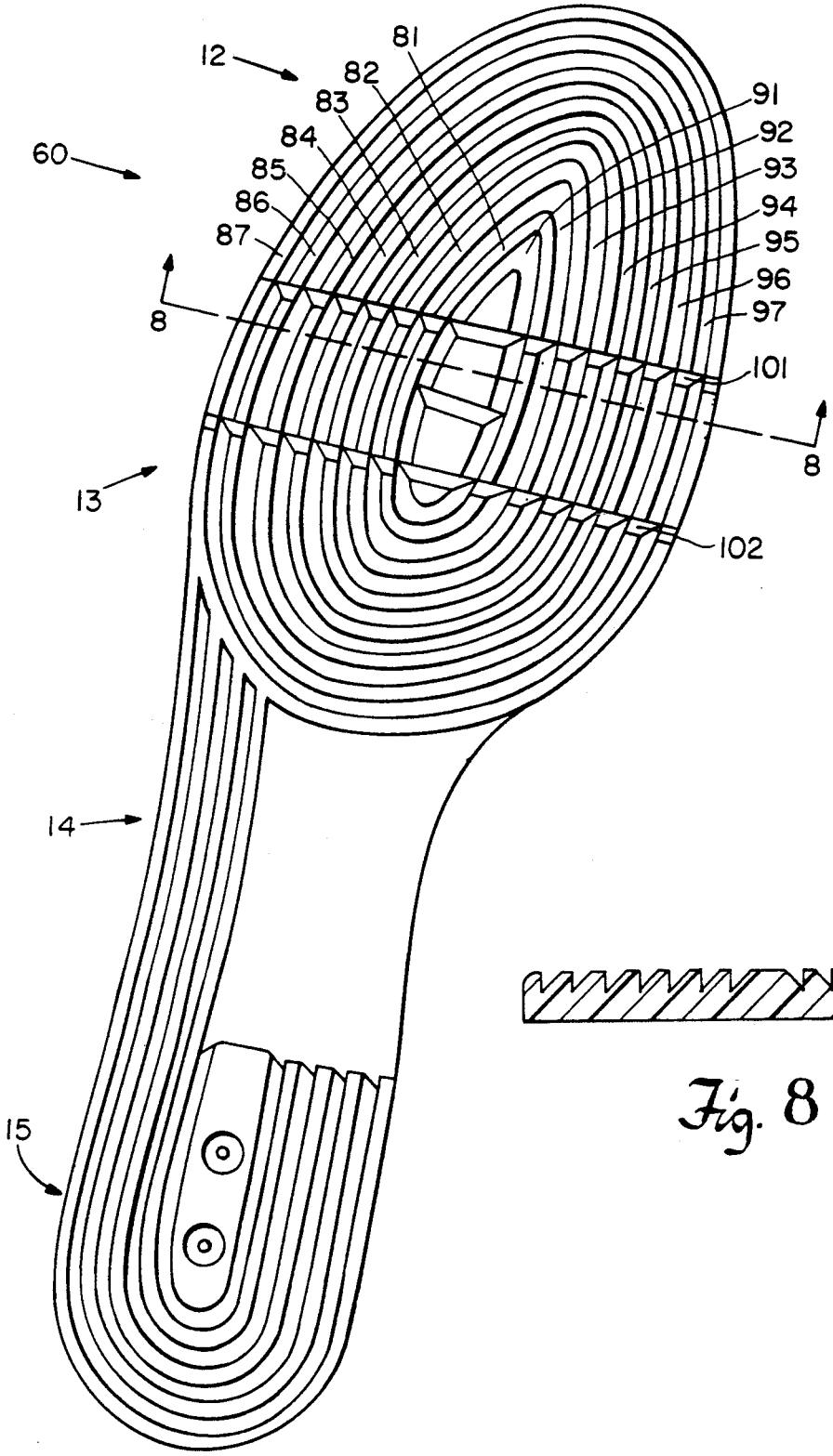
FIGS. 7 and 8 are plan and cross-section views, respectively, of the total outer sole surface of a grass court tennis or deck shoe showing the arrangement of grooves and ribs thereon in accordance with the present invention.

FIGS. 3, 5 and 7 show plan views of three athletic shoe sole surfaces (the right shoe viewed from the bottom of the shoe), for high traction during inertial changes. The groove and rib designs shown are called herein: "Vector Encompassed And Dynamically Oriented", or VEDO outer sole shoe designs. They solve the problems of slipping and enable the following conditions;

1. As the wearer accelerates, decelerates, or changes direction of motion, he sets up force vectors between the sole of his shoe and the playing surface that can cause slipping.

2. As these movement changes occur, the center of gravity (the point at which all forces can be considered to be acting) of the sole print (the sole contact with the playing surface) moves toward the perimeter of the sole in the new direction of motion and the area of the contact diminishes directly with the amount of foot flexing and the stiffness of the sole.

3. The vectors which cause foot slipping act toward the original center of gravity from the new direction of motion and/or the new center of gravity.

The generic shoe sole design shown in FIGS. 1 and 2 and the three particular VEDO outer sole shoe designs of FIGS. 3, 5 and 7 incorporate the following features to prevent and control the slipping that arises as described above:

(a) The outer sole is molded of a high hydrocarbon material to provide a high natural coefficient of friction with the playing surface (high hydrocarbon material is rubber with little or no filler material).

(b) The concentric closed loop groove and rib design is one rib loop within another parallel to the perimeter of the sole and centered on the static center of gravity of the sole so that as the vectors representing the motion of the wearer point outward toward and beyond the perimeter in the new direction, the related vectors representing the slip resistant forces point inward across (transverse to) the areas of ribs which are bearing the weight of the wearer and are in most intimate contact with the playing surface.

Figure 2A:
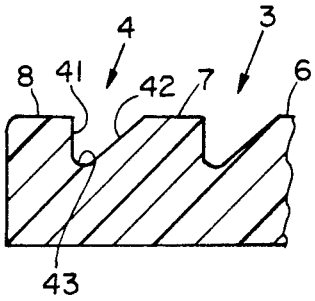
FIG. 2*a* shows an enlarged part of FIG. 2 revealing the cross-section structure of the groove.

(c) The grooves 1 to 4, as shown particularly in FIGS. 2 and 2*a* that define ribs 5 to 8, have a perpendicular outside wall like wall 41 of groove 4 and a tapered or sloping inside wall 42 that tapers or slopes toward the outside wall and these groove walls of adjacent grooves define a rib that has a tendency to "clean" hard playing surfaces so that the rib surface will stick to the hard playing surface and to "bite" into soft playing surfaces.

(d) The outside and inside walls like 41 and 42 of groove 4 meet at the bottom 43 of the groove 4. One purpose of this shape groove is to give the corresponding shape to the rib between adjacent grooves, like rib 7 between grooves 3 and 4. More particularly, it gives the rib section a direction of particularly high friction with the playing surface and that direction is the direction of likely slipping due to normal intentional maneuvers by the wearer that are characteristic of the game. Thus, the rib has only one perpendicular side, on the inside of the rib (toward the center of the sole area), which always faces the resistance, and the tapered or beveled side of the rib, on the outside thereof, faces the periphery 16 of the sole and is not required to stop slipping as much as the side toward the center of the sole area. This slight degradation of the slip resistance provided by the ribs is in the least likely directions of slipping.

(e) If both walls of a groove were perpendicular to the sole surface 9, the groove would tend to clog or pick up and trap hard particles in the groove and those particles would reduce traction and could damage wood floors, and the groove would be more likely to become packed with soft material and so obliterate the adjacent ribs. For these reasons also, the groove has only one perpendicular wall so that it tends not to pick up hard particles or become clogged.

(f) The bottom of the grooves, such as bottom 43 of groove 4, are preferably slightly rounded to avoid tear starts into the sole.

(g) The grooves tend to increase the flexibility of the sole allowing the weight bearing surface of the sole (surface 9 of the ribs) to broaden in width along the ribs normal to the line of thrust as the motion approaches the "kick off" edge, reducing the likelihood of slipping.

Turning next to FIGS. 3 to 8 there are shown three particular designs according to VEDO, for basketball, hard court tennis, racketball and squash and grass court tennis and deck shoes.

Basketball Shoe

Figure 4:
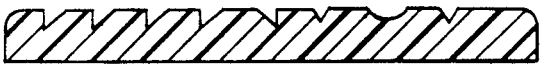

The VEDO basketball shoe outer sole 40 shown in FIGS. 3 and 4 contains substantially closed loop grooves 41 to 44 and ribs 45 to 48 in the surface 49 of the sole, that may be the same as those in FIGS. 1 and 2. It also has a pivot point 50 defined by a circular groove 51 and a circular recess 52 at the center of that groove, defining a small circular rib 53, which may be either slightly raised or consist of a harder material than the rest of the sole to facilitate the pivoting movements common to basketball.

Lateral straight grooves 54 and 55 across the ball area 13 of basketball outer sole 40 give added traction to avoid slipping forward or backward. These grooves are primarily for flexibility, but they also allow portions of the ribs to act independently to maintain better contact with the playing surface when the sole flexes. Thus, both walls of each of these grooves may be sloped (no forward vs backward anti-slip direction preference), or one wall of the groove may be perpendicular to the sole surface as taught herein to add directed traction.

The ribs 45 to 48 and the center surface 49*a* and the ribs 57 in the arch area 14 and the ribs 58 in the heel area 15 are preferably buffed to a dull finish with a sanding machine radiating from the center out. This raises thousands of microscopic "fingers" on the ribs which penetrate microscopic imperfections in the smooth hard playing surface (like a wood floor) improving traction. Depending on the floor condition, this feature may become wax contaminated, however, traction can be restored by washing with any naptha-like solvent to remove the wax.

Hard Court Tennis, Racketball or Handball Shoe

Figure 6:
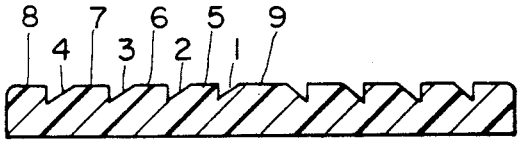

The VEDO hard court tennis racketball or handball shoe outer sole 60 shown in FIGS. 5 and 6 is very similar to the VEDO basketball shoe, but without the pivot area. For handball, squash or tennis shoes use on wood, tile, asphalt or clay courts. In these games, starting and stopping actions are paramount to pivoting actions. In addition to closed loop grooves 61 to 64 and ribs 65 to 68 and the surface 69*a* of the sole, that may be the same as those in FIGS. 1 and 2, it has lateral straight grooves 71, 72 and 73 across the ball area 13 to give added traction to avoid slipping forward or backward. As for the basketball shoe, these lateral grooves may or may not give preferred anti-slip direction to the sectioned ribs 76 and 77 created therebetween. Both walls of each of these lateral grooves may be sloped (no forward vs backward anti-slip direction preference), or one wall of the groove may be perpendicular to the sole surface as taught herein to give such directivity.

Grass Court Tennis or Deck Shoe

Figure 8:
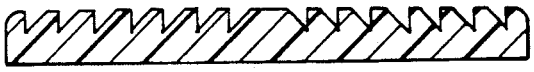

The VEDO grass court tennis or deck (yacht) shoe sole 80 shown in FIGS. 7 and 8 is similar to the hard court tennis shoe and has more numerous, narrower, more flexible ribs stressing more the wiping, action of the rib edges across blades of grass than the friction of the rib surface. In the toe and ball areas 12 and 13 are closed loop grooves 81 to 87 forming ribs 91 to 97 in the surface 98 of the sole, that may be the same as those in FIGS. 1 and 2. In addition it has lateral straight grooves 101 and 102 across the ball area 13 to give added traction to avoid slipping forward or backward. As for the basketball and hard court tennis shoes, these lateral grooves may or may not give preferred anti-slip directivity to the sectioned rib 98 created therebetween. Both walls of each of these lateral grooves may be sloped (no forward vs backward anti-slip directivity preference), or one wall of the groove may be perpendicular to the sole surface as taught herein to give such directivity. Slipping on grass or boat decks is often related to the wetness of the surface.

Wet, Frozen or Snow Covered Playing Surfaces

The wearer of an athletic shoe with such grooves as described above must still deal with water on the playing surface which is a lubricant for rubber and rubber-like materials. Because of its increased flexibility due to the greater number of rib loops, the grass court tennis and deck sole 90 is also useful on artificial turf, particularly when the artificial turf is wet. It is also useful on frozen or snow covered natural grass fields. The more flexible, more numerous ribs of sole 90, in which the grooves and ribs are shaped as shown in FIG. 2*a*, tend to wipe moisture off of the tufts of blades that make up the surface of conventional artificial turf. The wiping action removes the water that interferes with traction allowing the surface of the rib to contact the tufts without the water lubricant in between. The same wiping action applies to frozen natural grass surfaces where it is not the ice that is slippery so much as the layer of water on the ice created by the pressure of the shoe against the surface that is contacted by the sole. Hence this shoe is useful for football on frozen or snow covered fields.

Conclusion

In view of the above, it will be seen that the several objects of the present invention are achieved and the intended features are incorporated in the embodiments. It is to be understood that the invention is not limited in its application to the details of construction and arrangements illustrated in the embodiments, since the invention is capable of other embodiments and of being practiced or carried out in other ways. Also, it is to be understood that the terminology employed herein is for the purpose of description and not of limitation. Since changes could be made in the constructions described herein without departing from the scope of the invention, it is intended that all matter contained in the descriptions of embodiments herein or shown in the accompanying drawings shall be interpreted as illustrative and not in a limiting sense and it is also intended that the appended claims shall cover all such equivalent variations as come within the spirit and scope of the invention.

What is claimed is:

1. In an athletic shoe for use on a hard playing surface, a shoe outer sole having within the periphery of said sole a toe area and a ball area, a plurality of adjacent grooves in the surface of the sole in said toe and ball areas thereof, said adjacent grooves defining a rib therebetween, thereby providing a plurality of adjacent ribs that correspond to said adjacent grooves, said ribs having rib faces that form said surface of said sole, the improvement comprising:

(a) each groove is defined by two evenly spaced apart walls and the groove bottom, said walls being transverse to said sole surface and said groove bottom, (b) groups of said grooves are substantially parallel to the nearest part of said sole periphery, (c) for each groove in a group, the wall thereof nearest said part of said sole periphery is perpendicular to said sole surface and (d) the other wall of said groove is at least partially tapered toward said perpendicular wall, (e) said perpendicular wall of a groove forms one wall of a rib and said tapered wall of the adjacent groove forms the other wall of said rib, (f) whereby said groups of grooves form corresponding groups of said ribs and said ribs, when moving across said playing surface with said perpendicular wall thereof leading said motion makes relatively high friction contact therewith.

2. An athletic shoe as in claim 1 wherein said tapered wall of each of said grooves tapers significantly toward said perpendicular wall thereof to inhibit entrapment of foreign particles and material within said groove.

3. An athletic shoe as in claim 1 wherein some of said ribs are arranged on the left and the right sides of said sole ball area and said perpendicular walls of said ribs so arranged face toward the longitudinal center of said sole.

4. An athletic shoe as in claim 1 wherein some of said ribs are arranged at said sole toe area and said perpendicular walls of said ribs so arranged face toward the heel of said shoe.

5. An athletic shoe as in claim 1 wherein said sole has an arch area within said periphery thereof, some of said ribs are arranged just forward of said sole arch area and said perpendicular walls of said ribs so arranged face toward the toe of said shoe.

6. An athletic shoe as in claim 1 wherein said sole has a heel area within said periphery thereof, some of said ribs are arranged at the back of said sole heel area and said perpendicular walls of said ribs so arranged face toward the toe of said shoe.

7. An athletic shoe as in claim 1 wherein said sole has an arch area within said periphery thereof, some of said ribs are arranged just rearward of said sole arch area and said perpendicular walls of said ribs so arranged face toward the heel of said shoe.

8. An athletic shoe as in claim 1 wherein one of said ribs is arranged in a closed loop on said sole ball area and said perpendicular walls of said ribs so arranged face toward the center of said ball area.

9. An athletic shoe as in claim 1 wherein some of said ribs are arranged in concentric closed loops on said sole ball area and said perpendicular walls of said ribs so arranged face toward the center of said ball area.

10. An athletic shoe as in claim 9 wherein said sole has a heel area within said periphery thereof, some of said ribs are arranged in loops along the periphery of said sole heel area and said perpendicular walls of said ribs so arranged face away from said heel area periphery.

11. An athletic shoe as in claim 10 wherein some of said ribs are arranged in loops along the periphery of the back of said sole heel area and said ribs so arranged face toward the center of said heel area.

12. In an athletic shoe for use on a relatively hard playing surface, an outer sole for the shoe having a periphery and a plurality of adjacent grooves therein that define a plurality of adjacent ribs that provide friction surfaces against said playing surface, the improvement comprising, (a) each of said grooves is defined by two evenly spaced apart walls and the groove bottom, said walls being transverse to the surface of said sole and said groove bottom, (b) one of said walls is perpendicular to said sole surface, (c) the other of said walls is tapered toward said one wall and toward the closest part of said sole periphery and so that the groove thereof is narrower at the bottom than at the top thereof during intentional maneuvers of said wearer.

13. In an athletic shoe for use on a relatively hard playing surface, an outer sole for the shoe having a periphery and a plurality of adjacent grooves therein that define a plurality of adjacent ribs that provide friction surfaces against said playing surface, the improvement comprising, (a) each of said grooves is defined by two evenly spaced apart walls and the groove bottom, said walls being transverse to the surface of said sole and said groove bottom, (b) one of said walls is perpendicular to said sole surface, (c) the other of said walls is tapered toward said one wall and toward the closest part of said sole periphery and (d) said tapered wall of each of said grooves faces the direction of movement of the wearer of said shoe when said wearer resists movement in said direction during intentional maneuvers of said wearer, (e) whereby said adjacent rib friction surface, when moving across said playing surface in said direction wipes moisture particles from said playing surface, thereby maintaining friction between said rib friction surface and said playing surface.

14. In an athletic shoe for use on a relatively hard smooth playing surface, an outer sole for said shoe having a toe area, a ball area, an arch area and a heel area within the periphery of said sole, a plurality of adjacent grooves in at least some of said areas that define a plurality of adjacent ribs that provide friction surfaces against said playing surface, the improvement comprising, (a) said grooves in said toe and ball areas are each formed in a closed loop, one loop inside another, parallel to the periphery of said sole toe and ball areas (b) each groove is defined by two evenly spaced apart walls, an outer wall and an inner wall, (c) said outer wall being closer to said sole periphery than said inner wall to, (d) said outer wall is perpendicular to said adjacent rib friction surface of said sole and (e) said inner wall is tapered toward said outer wall, (f) whereby said adjacent rib friction surface, when moving across said playing surface away from said sole periphery that said rib is parallel to makes relatively high friction contact therewith and inhibits entrapment of and materials within said grooves.

* * * * *